US007770418B2

(12) United States Patent
Kramme et al.

(10) Patent No.: US 7,770,418 B2
(45) Date of Patent: Aug. 10, 2010

(54) TREATING AGENT DISPENSING DEVICE FOR USE IN A WASHING MACHINE

(75) Inventors: Friedrich-Wilhelm Kramme, Ruethen (DE); Nadine Makuc, Marienfeld (DE); Robert Muether, Rheda-Wiedenbrueck (DE)

(73) Assignee: Miele & Cie. KG, Guetersloh (DE)

( * ) Notice: Subject to any disclaimer, the term of this patent is extended or adjusted under 35 U.S.C. 154(b) by 756 days.

(21) Appl. No.: 11/623,176

(22) Filed: Jan. 15, 2007

(65) Prior Publication Data

US 2007/0163307 A1 Jul. 19, 2007

(30) Foreign Application Priority Data

Jan. 17, 2006 (DE) ..... 10 2006 002 400

(51) Int. Cl.
*D06F 39/02* (2006.01)

(52) U.S. Cl. ..... 68/17 R; 68/207

(58) Field of Classification Search ..... 68/17 R, 68/207

See application file for complete search history.

(56) References Cited

U.S. PATENT DOCUMENTS

| | | | | |
|---|---|---|---|---|
| 4,700,554 | A * | 10/1987 | Eichman et al. | 68/17 R |
| 5,613,379 | A * | 3/1997 | Kim | 68/17 R |
| 6,227,012 | B1 * | 5/2001 | Borroni et al. | 68/17 R |
| 6,826,933 | B2 * | 12/2004 | Merkle et al. | 68/17 R |
| 7,313,934 | B2 * | 1/2008 | Heo et al. | 68/17 R |
| 7,481,082 | B2 * | 1/2009 | Cho et al. | 68/17 R |
| 2003/0145633 | A1 | 8/2003 | Merkle et al. | |
| 2005/0229652 | A1 | 10/2005 | Kim et al. | |

FOREIGN PATENT DOCUMENTS

| | | | |
|---|---|---|---|
| CH | 450340 | | 1/1968 |
| DE | 75 13 925 | | 8/1975 |
| DE | 34 04 247 | | 8/1985 |
| DE | 3715832 | | 11/1988 |
| DE | 195 05 292 | | 2/1997 |
| DE | 10049316 | | 1/2002 |
| DE | 101 50 878 | | 7/2002 |
| EP | 0 685 587 | | 12/1995 |
| EP | 0725182 | | 8/1996 |
| GB | 2 187 764 | * | 9/1987 |
| GB | 2 022 622 | * | 12/2009 |
| WO | WO-03057970 | | 7/2003 |

OTHER PUBLICATIONS

European Search Report for European Application Serial No. EP 06 02 5630, dated Apr. 27, 2007.

* cited by examiner

*Primary Examiner*—Frankie L Stinson
(74) *Attorney, Agent, or Firm*—Leydig, Voit & Mayer, Ltd.

(57) ABSTRACT

A dispensing device for liquid and/or powdered treating agents includes a compartment for holding a first treating agent. A first nozzle is disposed above a lateral region of the compartment and configured to convey water therethrough onto the first treating agent. A second nozzle is disposed above a central region of the compartment and configured to convey water therethrough onto the first treating agent. A receptacle configured to hold a second liquid treating agent can be inserted into the compartment so as to form a gap between a wall of the receptacle and a wall of the compartment. Introduction of water through the first nozzle and the second nozzle is selectively controllable.

10 Claims, 7 Drawing Sheets

TREATING AGENT DISPENSING DEVICE FOR USE IN A WASHING MACHINE

Priority is claimed to German patent application DE 10 2006 002 400.1, filed Jan. 17, 2006, which is hereby incorporated by reference herein.

The present invention relates to a dispensing device for liquid and/or powdered treating agents, which is intended for use in a washing machine and includes at least one compartment for holding the treating agent and further includes nozzles which are located above the compartment and through which water is directed onto the treating agent.

BACKGROUND

Detergent drawers which are equipped with a dispensing device are known. The dispensing device flushes fresh water through the compartments of the drawer, so that the powdered or liquid detergent contained therein is carried away by the introduced water and mixed therewith in order to be fed to the washing process. Thus, for example, German Documents DE 101 50 878 A1 and DE 75 13 925 U1 describe a distribution box for a washing machine, having various delivery channels through which the various detergents can be released. Another embodiment of a drawer for a washing machine is known from EP 0 685 587 A1, where an assignable tank for holding a liquid bleach is disposed in one of the compartments. German Patent Application DE 195 05 292 A1 describes another drawer for a detergent dispensing device, which also has a plurality of compartments, one of said compartments being intended to hold the liquid detergent and cooperating with a so-called siphon device, which allows the liquid detergent to be released in a simple and reliable manner. German Patent Application DE 34 04 247 A1 describes a dispensing device for detergents, where the partition between two adjacent compartments has permanently formed therein an additional compartment for liquid detergents.

SUMMARY

An object of the present invention is to provide a detergent dispensing device for use in a washing machine, which will allow additional treating agents to be loaded and dispensed in a simple manner.

The present invention provides a dispensing device for liquid and/or powdered treating agents. The dispensing device includes a compartment for holding a first treating agent. A first nozzle is disposed above a lateral region of the compartment and configured to convey water therethrough onto the first treating agent. A second nozzle is disposed above a central region of the compartment and configured to convey water therethrough onto the first treating agent. A receptacle configured to hold a second liquid treating agent is receivable in the compartment so as to form a gap between a wall of the receptacle and a wall of the compartment. Introduction of water through the first nozzle and the second nozzle is selectively controllable.

BRIEF DESCRIPTION OF THE DRAWINGS

An exemplary embodiment of the present invention will be explained in more detail with reference to the following FIGS. 1 through 7, of which.

DETAILED DESCRIPTION

Figure 1:
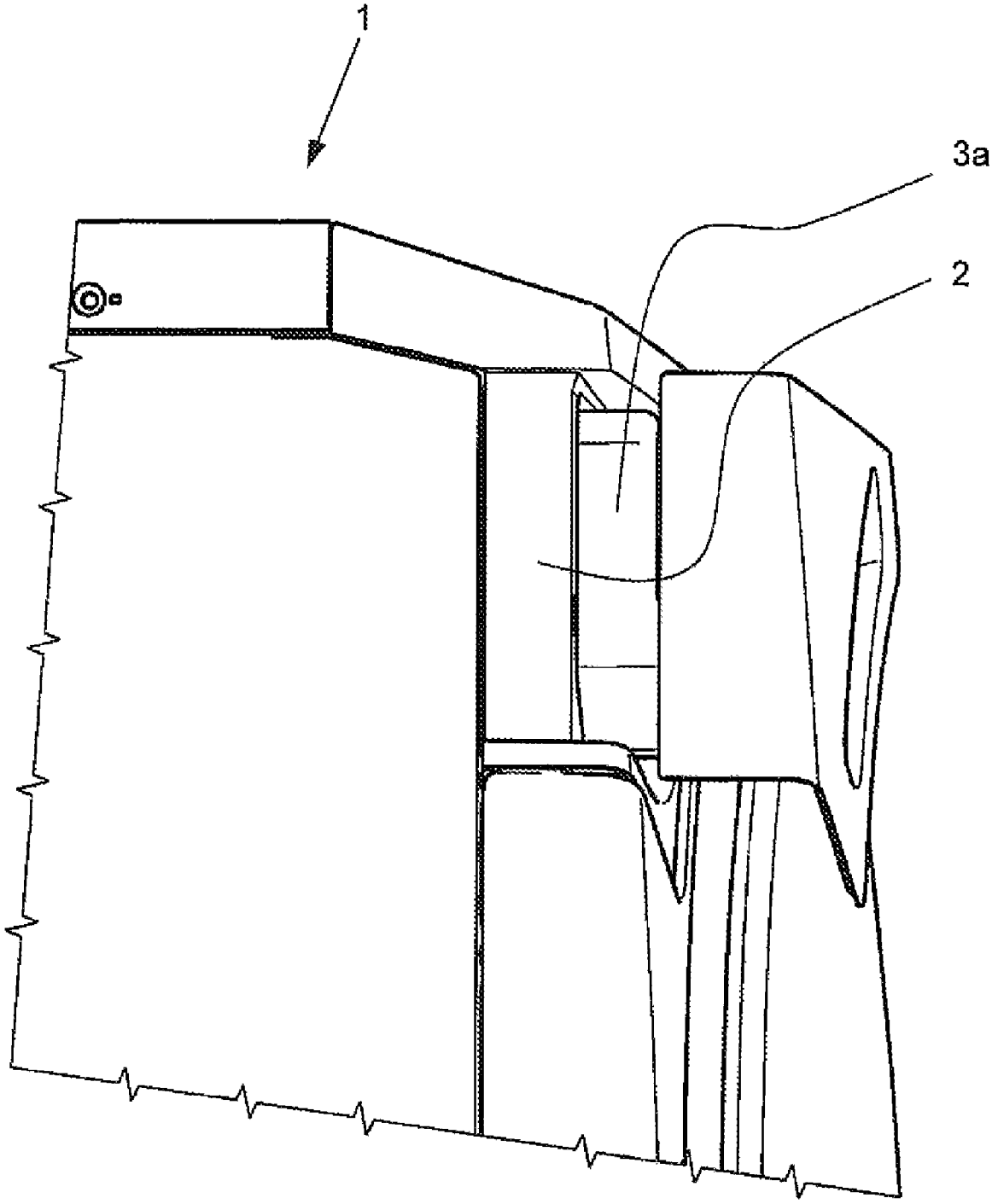
FIG. 1 is a perspective view of a washing machine with the drawer partially pulled out.

An advantage that can be achieved with the present invention is that at least two different treating agents can be stored at the same time in a compartment for holding a first liquid or powdered treating agent, such as detergent. To this end, an additional, separate receptacle for holding an additional, liquid treating agent, such as bleach, is inserted into the compartment for holding the detergent. In order to dispense the treating agent, nozzles are arranged above the compartment, water being directed therethrough into the compartment or into the receptacle onto the respective treating agent. In order to flush the treating agent from the compartment, a first subset of nozzles are provided, said first subset of nozzles being arranged in lateral portions above the compartment. A second subset of nozzles is provided for flushing the treating agent from the separate receptacle, said second set of nozzles being arranged in a central portion above the compartment or the inserted receptacle. The introduction of water through the first and second subsets of nozzles is selectively controllable, so that the respective treating agent is dispensed depending on the step in a wash or treatment program.

To provide for reliable dispensing, the receptacle is insertable into the compartment in such a manner that a gap is formed between the receptacle and the compartment wall. The subset of nozzles used for flushing the treating agent from the compartment are directed into the gap. Through the lateral gap between the receptacle and the walls of the compartment, the nozzles of the first subset spray the water onto the side walls and, thus, laterally under the detergent. This allows for proper flushing, without lumping of the detergent.

In an advantageous embodiment, the nozzles are arranged above the gap such that they are directed at an angle toward the compartment wall. Thus, the nozzles spray the water onto the compartment wall such that it flows down the compartment wall in a film-like manner, thus causing a flow around the treating agent, for example, a powdered detergent. The formation of the water film prevents adhesion to the compartment wall, because there is a continued flow of water through the first subset of nozzles until the compartment is empty. The first subset of nozzles is arranged in the dispensing device in such a manner that they are aligned along the compartment wall.

In order to empty the receptacle, it is convenient to arrange the second subset of nozzles substantially centrally above the receptacle. The receptacle itself has a cover having an elongated opening formed therein, said elongated opening also allowing water to be injected therethrough for emptying purposes. The second subset of nozzles are located above this opening to enable the water to be reliably flushed into the receptacle.

In an advantageous refinement for allowing the receptacle to be loaded in the front portion thereof, a hinged lid is provided.

In a second advantageous embodiment, spacers for bridging the gap are disposed on the exterior of the receptacle, leaving a space below the receptacle, through which space the treating agent is flushed out of the compartment. In this manner, the receptacle is given a certain stable position in the compartment, while providing an unobstructed flow around the treating agent and allowing the treating agent to be reliably flushed from the compartment.

In an advantageous refinement, the spacers have a wing-like shape in cross-section. This shape affects the passing flow of water in a manner that prevents or at least reduces the occurrence of unflushed areas at the spacers, thereby preventing the formation of lumps or residues of powdered treating agents on the compartment walls or receptacle walls.

In another embodiment, the receptacle has a device for nearly complete emptying. To this end, the bottom of the receptacle has an inclined or curved shape, which is terminated at its end by a siphon forming the rear wall of the receptacle. Thus, when fresh water is supplied via the dispensing device into the receptacle, the level relative to the siphon device reaches a height which causes the fluid to enter the so-called down tube for emptying, so that the receptacle is emptied automatically.

In a convenient embodiment, the receptacle is provided, on its exterior, with means for fixing its position within the compartment. For this purpose, it is convenient to provide the rear wall with a latch means which, when in its intended position, snaps into an opening in the rear compartment wall, whereby the position of the receptacle in the longitudinal direction in the compartment is reliably assumed and maintained.

The present invention further relates to a receptacle for a dispensing device of a washing machine, the receptacle being intended for holding liquid treating agent and being insertable into a compartment of a dispensing device. The compartment is designed to hold liquid or powdered treating agents, such as washing powder. The receptacle for holding an additional, liquid treating agent, such as bleach, can be inserted separately into the compartment, whereby a gap is formed between the receptacle and the compartment wall.

In a convenient embodiment, the receptacle has a cover having an elongated opening for water intake, a hinged lid for loading being provided in the front portion of the receptacle.

In order, in particular, to allow an unobstructed flow around the receptacle of the present invention, spacers for bridging the gap are disposed on the exterior of the receptacle, the spacers having a wing-like shape in cross-section. This design ensures, on the one hand, that the receptacle can be inserted into the compartment in a stable position without the flow of fresh water around the receptacle affecting the receptacle in any way, the shape of the spacers providing a surrounding flow with as little obstruction as possible.

In a refinement, the bottom of the receptacle is curved in cross-section, said curvature being terminated by a siphon forming the rear wall of the receptacle. This design provides, in particular, an emptying mechanism in the receptacle, said emptying mechanism being supplied via the dispensing device, so that the receptacle is emptied automatically.

FIG. 1 shows a portion of a washing machine 1 in a perspective view, an extendable drawer 3*a* being mounted into the front of washing machine 1. Drawer 3*a* includes one or more compartments for holding treating agents, a dispensing device 2 for flushing the treating agents from the compartments being disposed within the washing machine 1. Drawer 3*a* of dispensing device 2 is shown in more detail in the isolated view of FIG. 2. FIG. 3 shows dispensing device 2 in a perspective view, a flat upper part 3 being disposed above drawer 3*a*. In order to selectively control the water supply within upper part 3, a controllable water diverter 4 is provided, said water diverter preferably being located at the rear end of upper part 3, which faces toward the interior of washing machine 1. The water supplied through a conduit 5 is directed by water diverter 4 into individual channels 15, 15.1, 15.2, which extend inside upper part 3 and have openings 7, 16 which are located above the individual compartments 6.1, 6.2 and act as nozzles (FIG. 4). The individual compartments provided in drawer 3*a*, as shown by the cross-sectional view of dispensing device 2 shown in FIG. 4, are in turn filled with water through these nozzles 7, 16. The entering water flushes the treating agent filled into the respective compartment 6.1, 6.2 out of compartment 6.1, 6.2 and into the suds container of washing machine 1.

Figure 2:
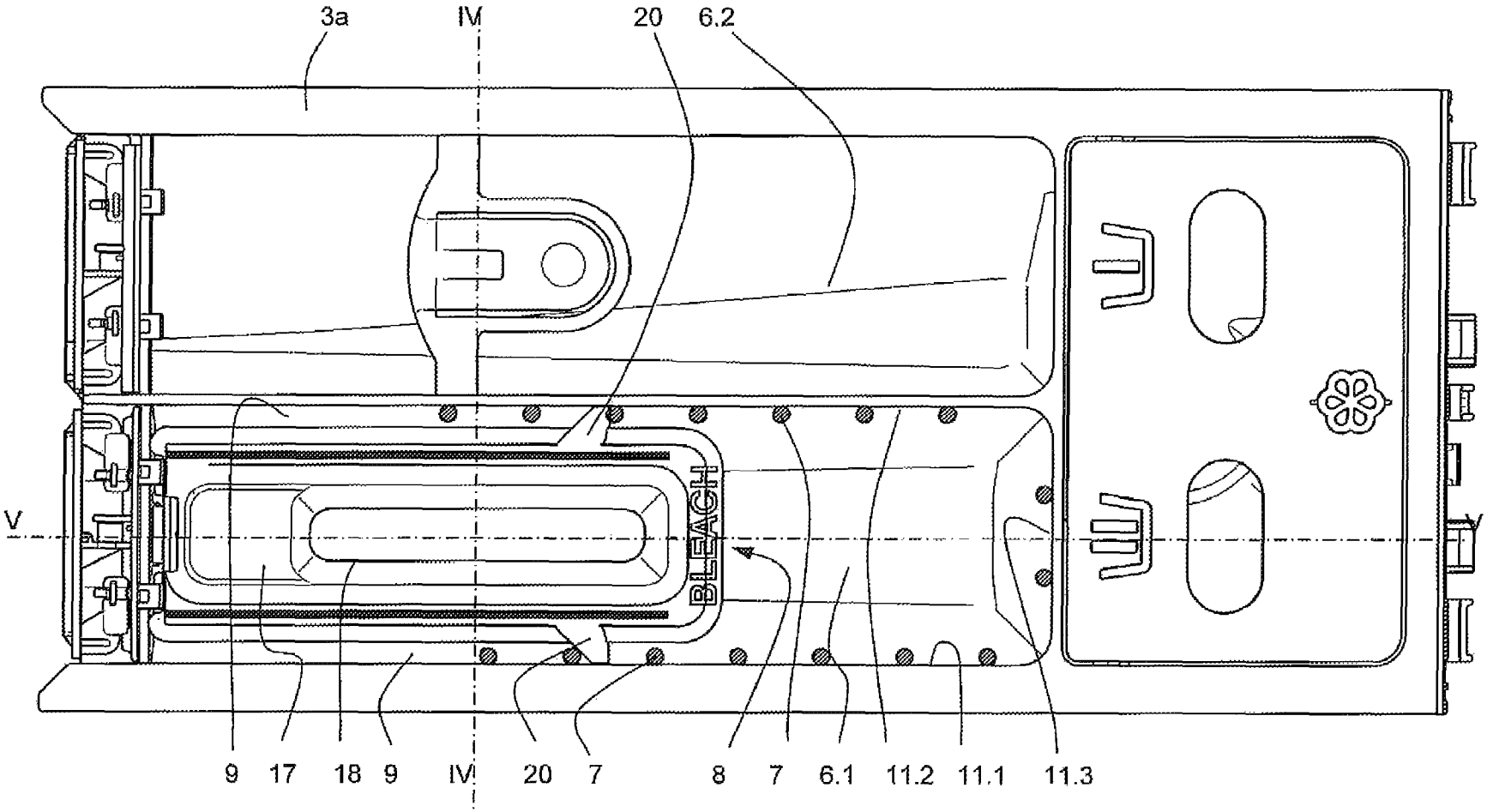
FIG. 2 is a top view of a drawer.
Figure 3:
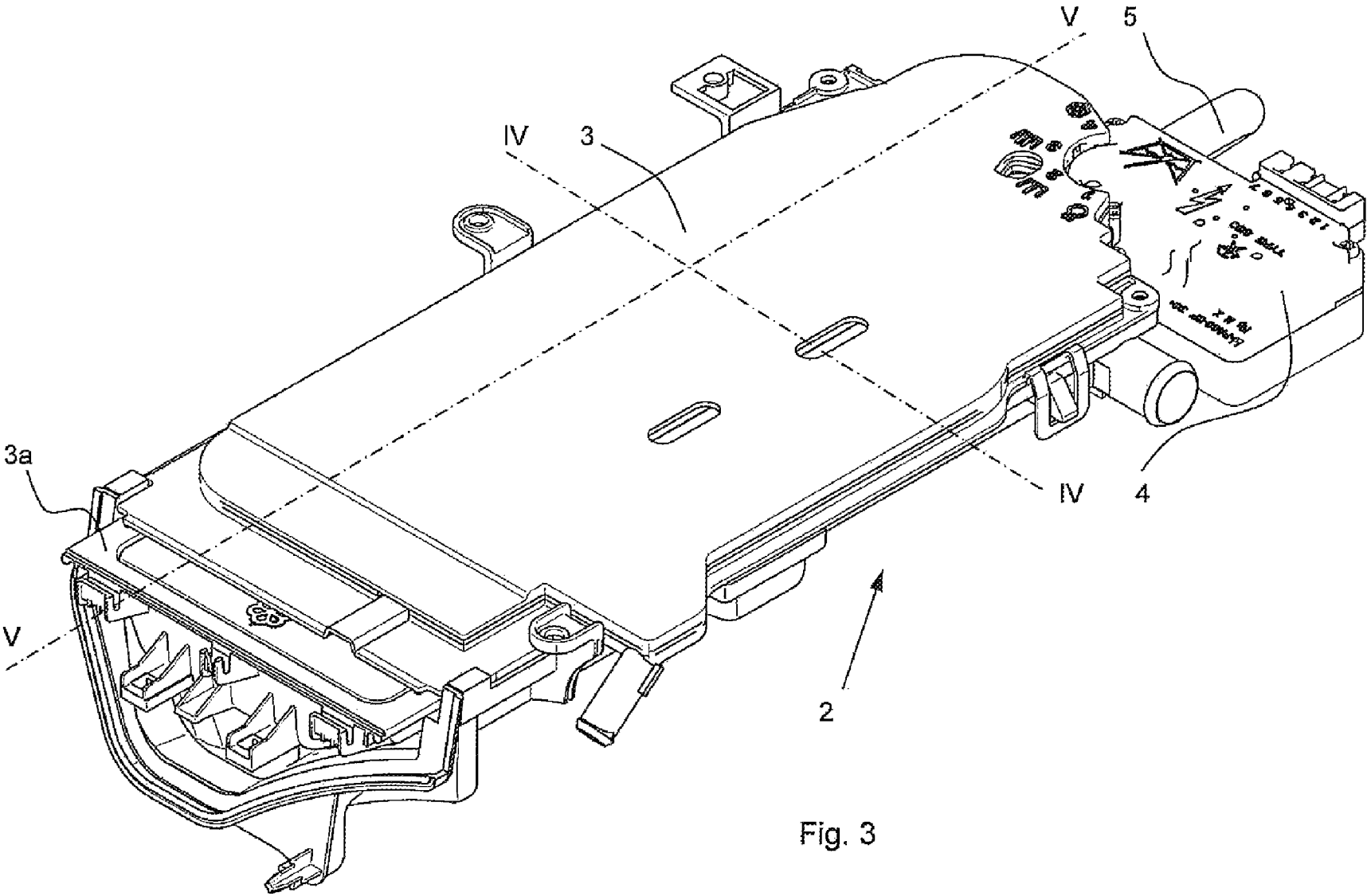
FIG. 3 is a perspective view of the dispensing device.
Figure 4:
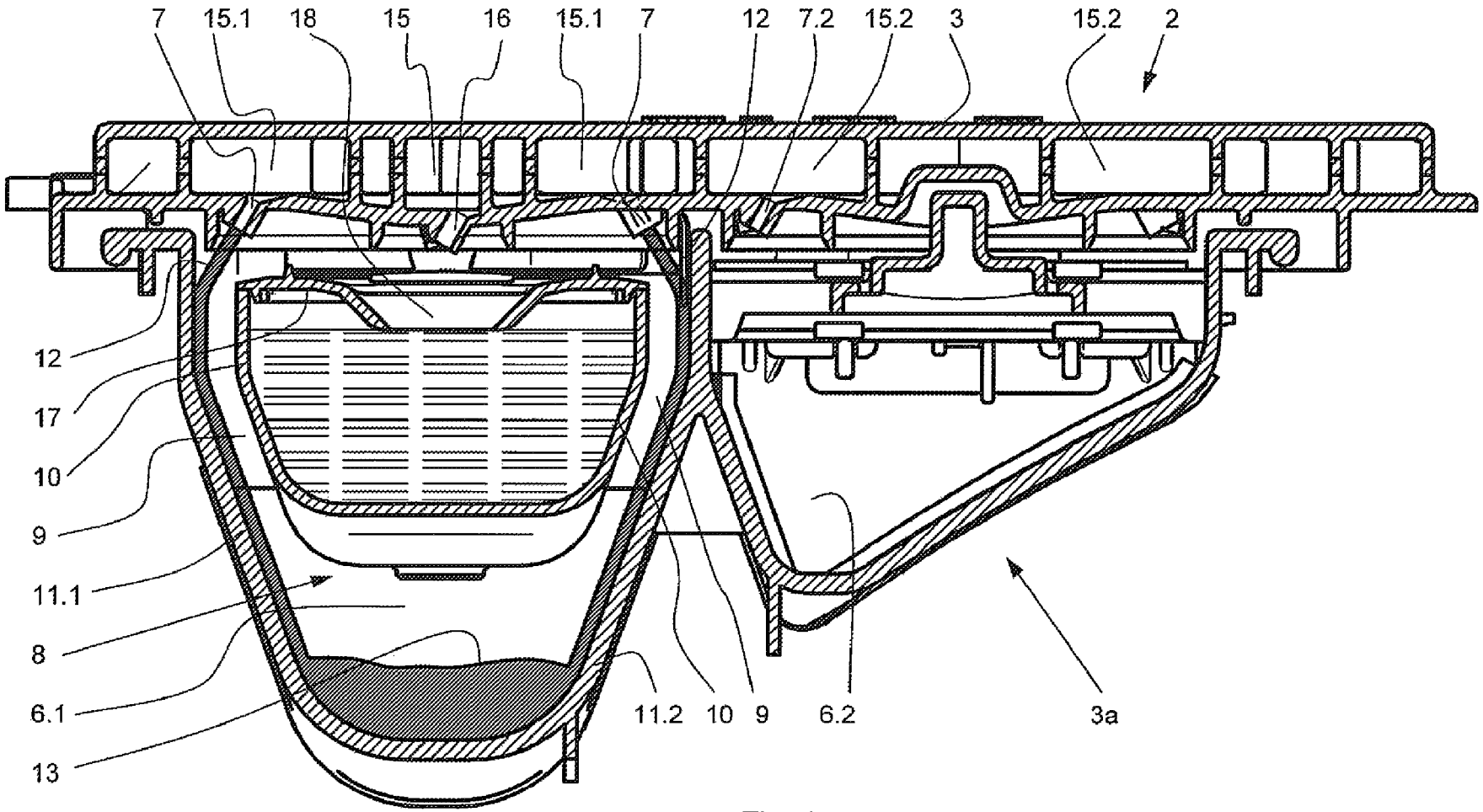
FIG. 4 is a transverse cross-sectional view of the dispensing device, taken along line IV-IV of FIG. 3.

It is apparent that upper part 3 of dispensing device 2, as shown in FIG. 3, is fixedly mounted in the washing machine housing, while drawer 3*a*, as illustrated in FIG. 2, can be pulled out from the front of washing machine 1. Drawer 3*a* includes two compartments 6.1 and 6.2, compartment 6.1 being intended for holding treating agent, here especially powdered detergent, for a main wash cycle. As indicated in FIG. 4, the treating agent is flushed out of compartment 6.1 or 6.2, respectively, by the water supplied for the washing process by means of upper part 3 disposed above drawer 3*a*. Upper part 3 includes nozzles 7 disposed at its underside, said nozzles being directed toward compartments 6.1 and 6.2. In accordance with the present invention, it is proposed that a separate receptacle 8 for holding a liquid additive, such as bleach, be disposed in one of compartments 6.1, 6.2, here especially in compartment 6.1, said separate receptacle being insertable into compartment 6.1, whereby a gap 9 is formed between receptacle wall 10 and compartment wall 11, the nozzles 7 of upper part 3 being directed into gap 9 for introducing the water into detergent compartment 6.1.

FIG. 4 further illustrates that water jets 12 produced by nozzles 7 each flow down along compartment wall 11, allowing a kind of liquid film to form on compartment wall 11. The liquid films flowing down the side walls 11.1 and 11.2 cause the stored treating agent to be, as it were, washed away from below in lower compartment portion 13, thus preventing lumping or adhesion of the treating agent, for example, detergent powder, from occurring in compartment 6.1. To this end, in particular, nozzles 7 are directed at an angle toward compartment walls 11.1 and 11.2, the nozzles being arranged in upper part 3 at positions above gap 9.

As can be seen in FIG. 2 by nozzles 7 indicated as dots, nozzles 7 are arranged in dispensing device 2 along the compartment side walls 11.1, 11.2 and end wall 11.3 so that, as already mentioned, they form this liquid film also on end wall 11.3. Looking at the illustration in FIG. 4, it is apparent that the water is supplied through upper channels 15, 15.1, 15.2 within upper part 3, the selective introduction of water into upper channels 15, 15.1, 15.2 being accomplished by water diverter 4, which is shown in FIG. 3. In order to empty the receptacle 8 inserted into compartment 6.1, further nozzles 16 are provided centrally between nozzles 7 for detergent compartment 6.1. These nozzles 16 are also arranged at an angle in upper part 3. In order for the water to be selectively introduced through these nozzles 16, upper part 3 has provided therein a separate channel 15 which is opened or closed by the water diverter for water inlet 5, depending on the step to be executed in the wash program. Nozzles 7 for flushing the treating agent from the compartment 6.1 are associated with channel 15.1. Nozzles 7.1 for flushing the treating agent from the compartment 6.2 are associated with channel 15.2.

Figure 5:
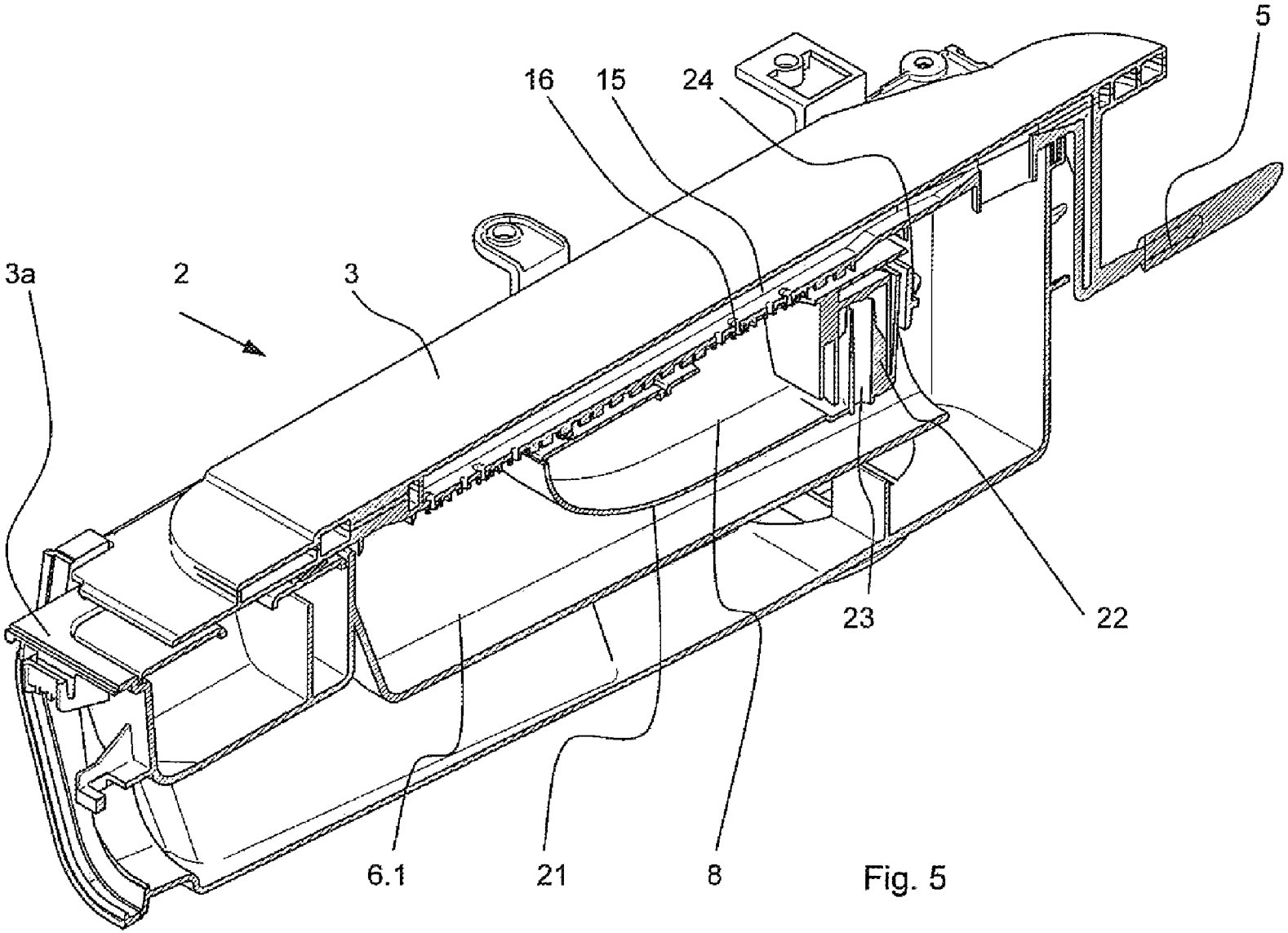
FIG. 5 is a longitudinal cross-sectional view of the dispensing device, taken along line V-V of FIG. 3.

FIG. 5 shows in a cross-sectional view, in particular, nozzles 16, which allow water to be supplied to the receptacle 8. To this end, an elongated opening 18 for water supply is provided in cover 17 of receptacle 8. A latch means 24 is disposed in the rear portion of receptacle 8 as a means for fixing receptacle 8 in position within compartment 6.1, said latch means being snappable into a corresponding latching edge or opening in the rear wall of compartment 6.1. Receptacle 8 is shown separately in FIG. 6.

Figure 6:
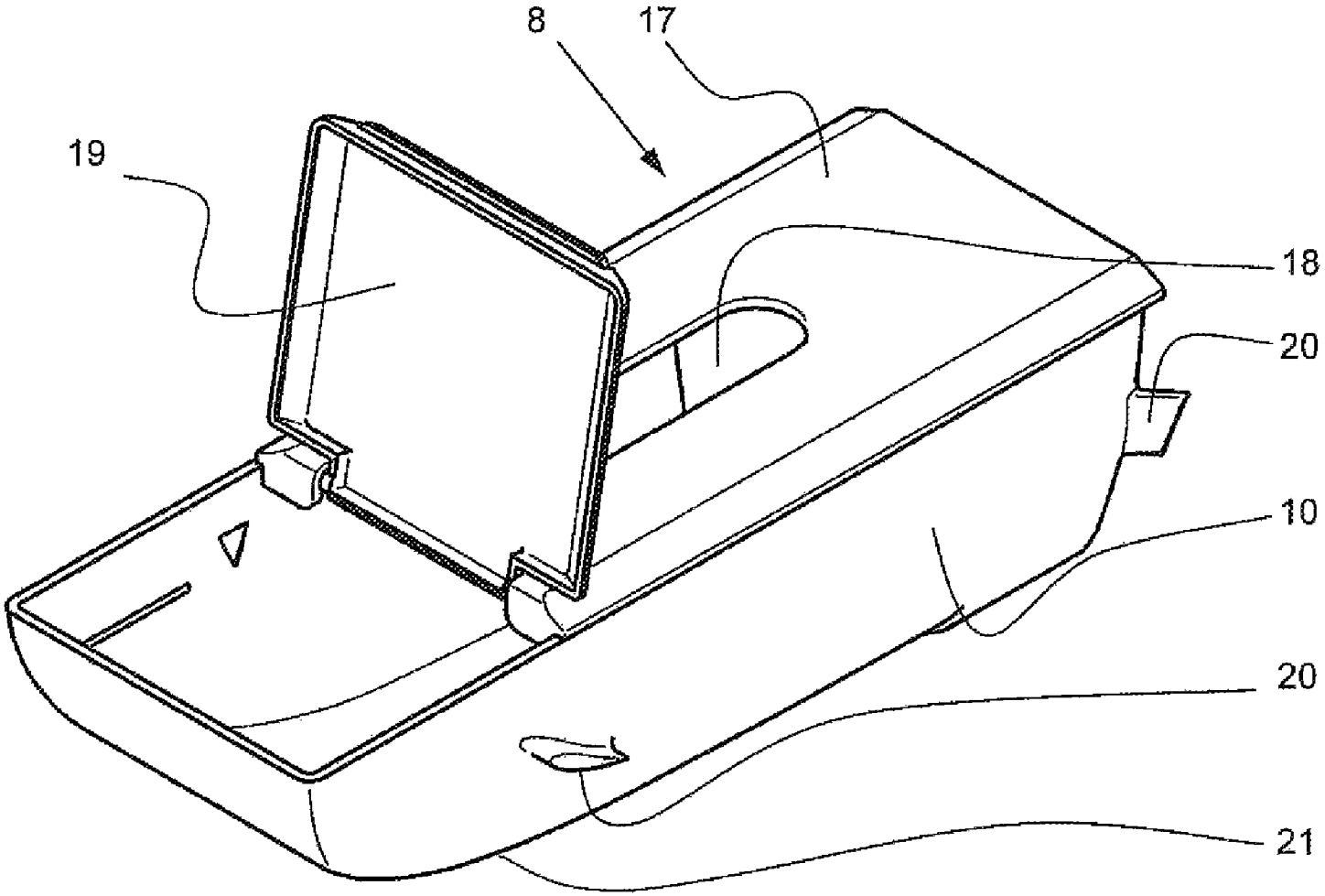
FIG. 6 is a perspective detail view of the receptacle with the front lid open.

The separately formed receptacle 8 shown in FIG. 6 has a hinged lid 19 disposed in the front portion for loading of liquid treating agent. When drawer 3*a* is pulled out, said hinged lid can be opened to fill in the liquid or viscous treating agent, such as bleach. As can be seen from both FIG. 6 and FIG. 2, receptacle 8 has formed on the exterior thereof spacers 20 for bridging gap 9. Thus, it becomes clear that receptacle 8 is easily insertable into the conically shaped compartment 6.1 and that, when receptacle 8 is inserted into compartment 6.1, the gap 9 is formed because of spacers 20, which always ensures flow through the lower portion of space 13 below receptacle 8.

In a refinement, in particular of spacers 20, spacers 20 have a wing-like shape in cross-section, as can be seen, for example, in FIG. 6. It is apparent that when, for example, the water film forms on compartment walls 11.1, 11.2, 11.3, no unflushed areas will be caused by spacers 20, since the spacers, because of their alignment with respect to the flow, will not give rise to any unsprayed areas which would result in lumping or adhesion of detergents.

In an advantageous refinement, bottom 21 of receptacle 8 has a curved shape in cross-section, as can be seen in particular in FIG. 5, a siphon 22 forming the rear wall of receptacle 8 at the end of the curvature. Siphon 22 operates in a generally known manner, siphon 22 substantially including a down tube 23 through which the liquid is removed from receptacle 8 when the liquid level rises in receptacle 8. In the process, the liquid rises in tube 23, for example, when water is added through nozzles 16, until the horizon of down tube 23 is reached at the upper end, so that the emptying process takes place because of the suction effect due to the communication effect.

Figure 7:
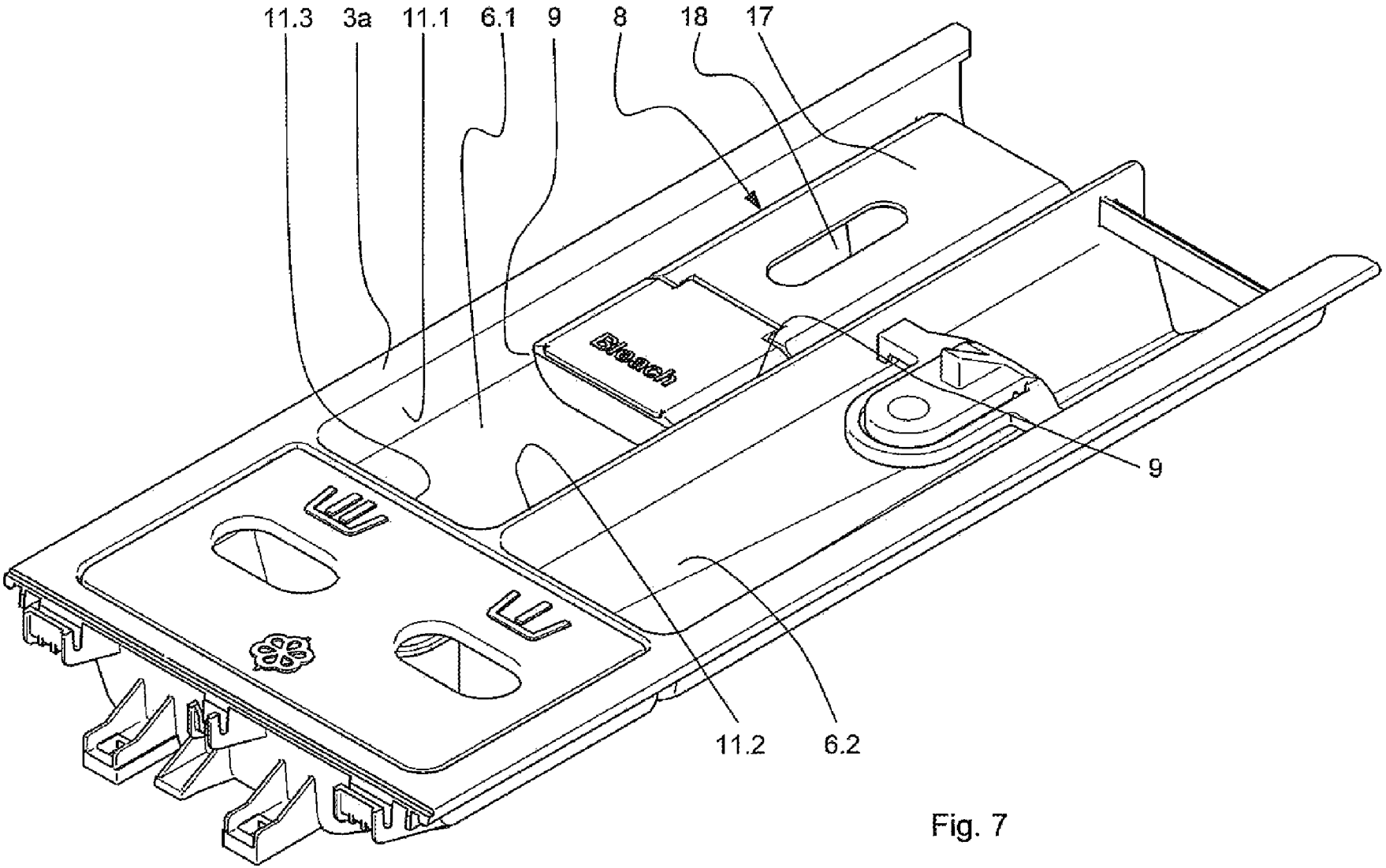
FIG. 7 is another perspective view of the drawer with the receptacle inserted and the upper part removed.

The present invention further relates to receptacle 8, as illustrated in FIGS. 6 and 7, which is intended for a dispensing device 2 for use in a washing machine 1, and the purpose of which is to hold treating agents, such as bleaches. The receptacle 8 can be inserted, as a separate receptacle 8 for holding the separate treating agent, for example bleach, into one of the compartments 6.1, 6.2 of a detergent drawer 3*a*, in particular into compartment 6.1 for holding the detergent, whereby a gap 9 for allowing flow through the lower portion of lower compartment space 13 is formed between receptacle wall 10 and compartment wall 11 of compartment 6.1. Receptacle 8 has a cover 17 having formed therein an elongated opening 18 for water intake. A hinged lid 19 for loading the bleach is disposed in the front portion 8, said hinged lid being easy to open when drawer 3*a* is pulled out. In a refinement, in particular of receptacle 8, relating to the insertion of receptacle 8 into compartment 6.1, receptacle 8 has formed on the exterior thereof spacers 20 for bridging the gap 9 for allowing flow through the lower portion. Spacers 20 have a wing-like shape in cross-section, which is intended to avoid, in particular, the development of unflushed areas, thus preventing formation of lumps of detergent in lower compartment space 13. Receptacle 8 itself has a bottom 21 having a curved shape, the receptacle 8 being bounded by a siphon 22, which also forms the rear wall of receptacle 8.

The present invention is not limited to the embodiment described herein; reference should be had to the appended claims.

What is claimed is:

1. A dispensing device for liquid and/or powdered treating agents, comprising:

a compartment for holding a first treating agent;

a first nozzle disposed above a lateral region of the compartment and configured to convey water therethrough onto the first treating agent;

a second nozzle disposed above a central region of the compartment and configured to convey water therethrough onto the first treating agent; and a receptacle configured to hold a second liquid treating agent, the receptacle being receivable in the compartment so as to form a gap between a wall of the receptacle and a wall of the compartment, the receptacle including a cover having an elongated opening configured to introduce water, the elongated opening being disposed below the second nozzle when the receptacle is received in the compartment;

wherein introduction of water through the first nozzle and the second nozzle is selectively controllable and the second nozzle is disposed above the receptacle and configured to empty the receptacle when the receptacle is received in the compartment.

2. The dispensing device as recited in claim 1 wherein the dispensing device is a dispensing device of a washing machine.

3. The dispensing device as recited in claim 1 wherein the first nozzle is directed into the gap so as to introduce water into the compartment.

4. The dispensing device as recited in claim 3 wherein the first nozzle is directed at an angle toward the wall of the compartment.

5. The dispensing device as recited in claim 1 wherein the receptacle includes a hinged lid disposed at a front portion thereof and configured to load the second liquid treating agent.

6. The dispensing device as recited in claim 1 wherein the receptacle includes a spacer extending from an exterior portion thereof and configured to bridge the gap.

7. The dispensing device as recited in claim 6 wherein the spacer includes a wing-like shape in cross-section.

8. The dispensing device as recited in claim 1 wherein the receptacle includes an emptying device configured to at least substantially empty the receptacle.

9. The dispensing device as recited in claim 8 wherein the receptacle has an inclined or curved shape in cross-section so as to enable an at least substantial emptying of the receptacle, and the emptying device includes a siphon forming a rear wall of the receptacle in a region of a lowest point at a rear end of the receptacle.

10. The dispensing device as recited in claim 1 wherein the receptacle includes a fixing device disposed at an exterior wall thereof and configured to fix a position of the receptacle within the compartment.

* * * * *